US010644375B1

(12) United States Patent
Chueh

(10) Patent No.: US 10,644,375 B1
(45) Date of Patent: May 5, 2020

(54) BRANCH-LINE COUPLER

(71) Applicant: NANNING FUGUI PRECISION INDUSTRIAL CO., LTD., Nanning (CN)

(72) Inventor: Yu-Chih Chueh, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 9 days.

(21) Appl. No.: 16/190,403

(22) Filed: Nov. 14, 2018

(51) Int. Cl.
*H01P 5/12* (2006.01)
*H01P 5/18* (2006.01)
*H01P 5/22* (2006.01)

(52) U.S. Cl.
CPC ..... *H01P 5/184* (2013.01)

(58) Field of Classification Search
CPC .... H01P 5/12; H01P 5/18; H01P 5/184; H01P 5/22
See application file for complete search history.

(56) References Cited

U.S. PATENT DOCUMENTS 4,697,161 A 9/1987 Buoli
6,727,767 B2 * 4/2004 Takada ..... H03B 5/326 310/313 R
6,753,745 B2 * 6/2004 Killen ..... H01P 5/227 333/117
7,671,698 B2 3/2010 Dupont et al.
8,044,748 B2 * 10/2011 Valenti ..... H04N 5/38 333/109
9,893,409 B2 * 2/2018 Chueh ..... H01P 5/227

FOREIGN PATENT DOCUMENTS

EP 0317717 B1 6/1993
TW 201838243 A 10/2018

* cited by examiner

*Primary Examiner* — Dean O Takaoka
(74) *Attorney, Agent, or Firm* — ScienBiziP, P.C.

(57) ABSTRACT

A small-scale branch-line coupler suitable for use in mobile devices includes a first, second, third, and fourth ports, respectively acting as input, transmission, coupled, and isolated ports. A first, second, third, and fourth connection parts are connected to the ports and transmission lines. First angular transmission lines are between first and second ports, third angular transmission lines are between third and fourth ports. A third long strip transmission line connects the first port and the fourth port. A fourth long strip transmission line connects the second port and the third port. The branch-line coupler occupies a small area and has high performance.

20 Claims, 6 Drawing Sheets

BRANCH-LINE COUPLER

FIELD

The subject matter herein generally relates couplers, and more particularly to branch-line couplers.

BACKGROUND

Branch-line couplers are widely applied to microwave integrated circuits and monolithic integrated circuits. The conventional branch-line coupler, such as the 3 dB branch-line coupler, is constituted of four quarter-wavelength lines. However, the branch-line coupler occupies a large area of the printed circuit board (PCB). Therefore, a minimized high performance 3 dB branch-line coupler would be preferred.

BRIEF DESCRIPTION OF THE DRAWINGS

Implementations of the present disclosure will now be described, by way of example only, with reference to the attached figures.

DETAILED DESCRIPTION

Figure 1:
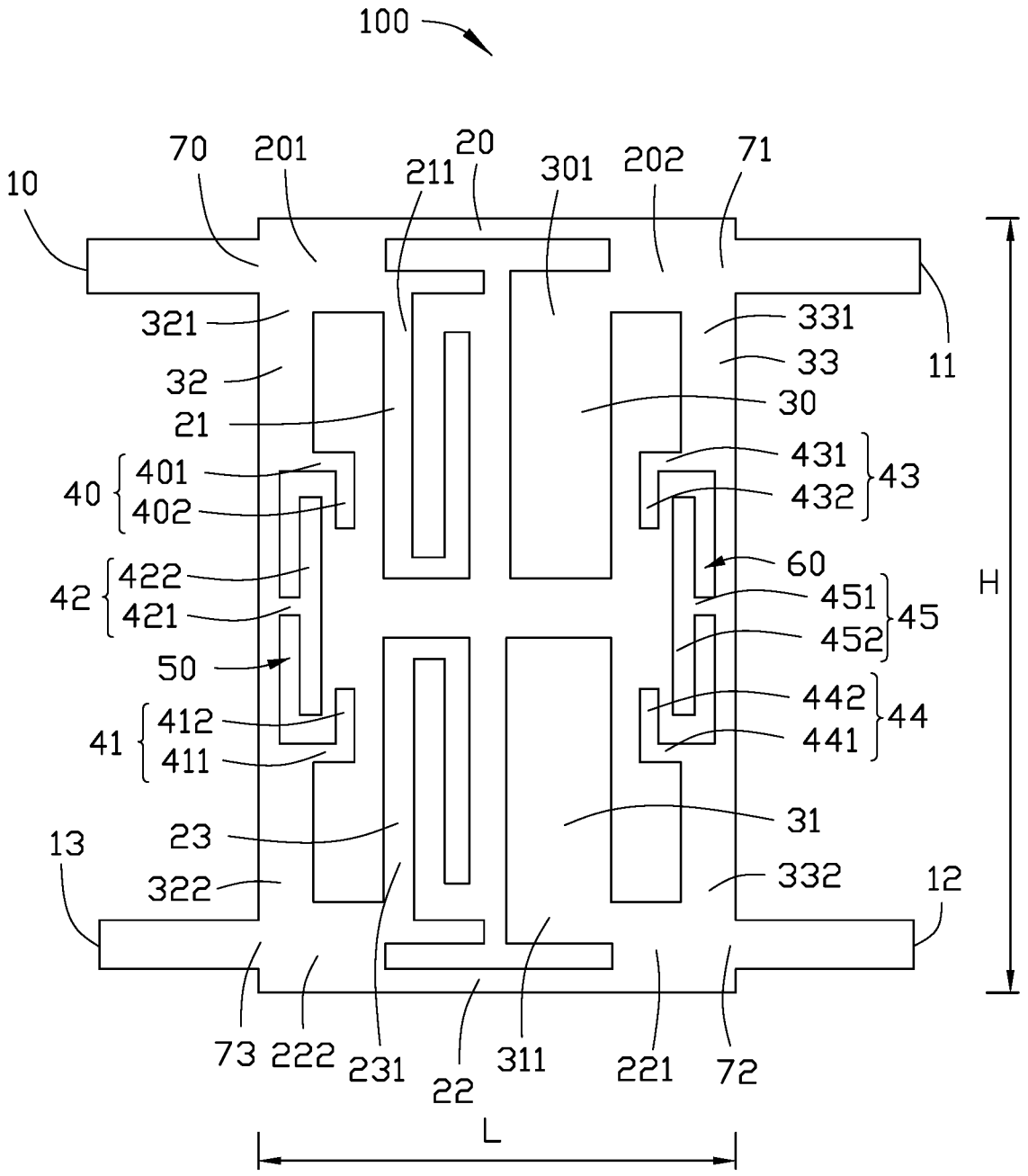
FIG. 1 is a circuit configuration of a branch-line coupler according to an embodiment of the disclosure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series, and the like.

FIG. 1 illustrates a branch-line coupler 100 in accordance with an exemplary embodiment. The branch-line coupler 100 is symmetrical about X axis.

The branch-line coupler 100 includes a first port 10, a second port 11, a third port 12, a fourth port 13, a first angular transmission line 20, a second angular transmission line 21, a third angular transmission line 22, and a fourth angular transmission line 23.

The branch-line coupler 100 also includes a first long strip transmission line 30, a second long strip transmission line 31, a third long strip transmission line 32, and a fourth long strip transmission line 33.

The branch-line coupler 100 further includes a first branch transmission line 40, a second branch transmission line 41, a third branch transmission line 42, a fourth branch transmission line 43, a fifth branch transmission line 44, and a sixth branch transmission line 45.

The first branch transmission line 40, the second branch transmission line 41, and the third branch transmission line 42 are extended from the third long strip transmission line 32. The first branch transmission line 40, the second branch transmission line 41, and the third branch transmission line 42 are located on an extending direction of the third long strip transmission line 32.

The fourth branch transmission line 43, the fifth branch transmission line 44, and the sixth branch transmission line 45 are extended from the fourth long strip transmission line 33. The fourth branch transmission line 43, the fifth branch transmission line 44, and the sixth branch transmission line 45 are located on an extending direction of the fourth long strip transmission line 33.

The first port 10 can be an input port, configured to receive electromagnetic wave signal. The second port 11 can be a transmission port, configured to output the electromagnetic wave signal from the input port. The third port 12 can be a coupled port, configured to output a coupled electromagnetic wave signal. The fourth port 13 can be an isolated port.

In at least one exemplary embodiment, a first end 201 of the first angular transmission line 20 is electrically connected to the first port 10, and a second end 202 of the first angular transmission line 20 is electrically connected to the second port 11. The first end 201 of the first angular transmission line 20 is electrically connected to an end 211 of the second angular transmission line 21, and the second end 202 of the first angular transmission line 20 is electrically connected to an end 301 of the first long strip transmission line 30.

In at least one exemplary embodiment, a first end 221 of the third angular transmission line 22 is electrically connected to the third port 12, and a second end 222 of the third angular transmission line 22 is electrically connected to the fourth port 13. The first end 221 of the third angular transmission line 22 is electrically connected to an end 231 of the fourth angular transmission line 23, and the second end 222 of the third angular transmission line 22 is electrically connected to an end 311 of the second long strip transmission line 31.

The second angular transmission line 21 is parallel with the first long strip transmission line 30, and the fourth angular transmission line 23 is parallel with the second long strip transmission line 31.

A first end 321 of the third long strip transmission line 32 is electrically connected to the first port 10, and a second end 322 of the third long strip transmission line 32 is electrically connected to the fourth port 13.

The third long strip transmission line 32 defines a first slot 50. The third branch transmission line 42 is received in the first slot 50. The first branch transmission line 40 and the second branch transmission line 41 are located on both sides of the third branch transmission line 42.

A first end 331 of the fourth long strip transmission line 33 is electrically connected to the second port 11, and a second end 332 of the fourth long strip transmission line 33 is electrically connected to the third port 12.

The fourth long strip transmission line 33 defines a second slot 60. The sixth branch transmission line 45 is received in the second slot 60. The fourth branch transmission line 43 and the fifth branch transmission line 44 are located on both sides of the sixth branch transmission line 45.

In at least one exemplary embodiment, both the first branch transmission line 40 and the second branch transmission line 41 are L-shaped. The third branch transmission line 42 is T-shaped.

The first branch transmission line 40 includes a first connection section 401 and a second connection section 402. The second branch transmission line 41 includes a third connection section 411 and a fourth connection section 412. The third branch transmission line 42 includes a first extension section 421 and a second extension section 422.

The first connection section 401 is electrically connected to the third long strip transmission line 32, the second connection section 402 is perpendicularly connected to the first connection section 401 to form the L-shape.

The third connection section 411 is electrically connected to the third long strip transmission line 32, the fourth connection section 412 is perpendicularly connected to the third connection section 411 to form the L-shape.

The first extension section 421 is electrically connected to the third long strip transmission line 32, and the second extension section 422 is perpendicularly connected to the first extension section 421 to form the T-shape.

In at least one exemplary embodiment, both the fourth branch transmission line 43 and the fifth branch transmission line 44 are L-shaped. The sixth branch transmission line 45 is T-shaped.

The fourth branch transmission line 43 includes a fifth connection section 431 and a sixth connection section 432. The fifth branch transmission line 44 includes a seventh connection section 441 and an eighth connection section 442. The sixth branch transmission line 45 includes a third extension section 451 and a fourth extension section 452.

The fifth connection section 431 is electrically connected to the fourth long strip transmission line 33 the sixth connection section 432 is perpendicularly connected to the fifth connection section 431 to form the L-shape.

The seventh connection section 441 is electrically connected to the fourth long strip transmission line 33, the eighth connection section 442 is perpendicularly connected to the seventh connection section 441 to form the L-shape.

The third extension section 451 is electrically connected to the fourth long strip transmission line 33, and the fourth extension section 452 is perpendicularly connected to the third extension section 451 to form the T-shape.

In at least one exemplary embodiment, the branch-line coupler 100 further includes a first connection part 70, a second connection part 71, a third connection part 72, and a fourth connection part 73.

The first connection part 70, the second connection part 71, the third connection part 72, and the fourth connection part 73 can be transmission lines.

The first angular transmission line 20 is electrically connected to the first port 10 through the first connection part 70, and the third long strip transmission line 32 is electrically connected to the first port 10 through the first connection part 70.

The first angular transmission line 20 is electrically connected to the second port 11 through the second connection part 71, the fourth long strip transmission line 33 is electrically connected to the second port 11 through the second connection part 71.

The third angular transmission line 22 is electrically connected to the third port 12 through the third connection part 72, and fourth long strip transmission line 33 is electrically connected to the third port 12 through the third connection part 72.

The third angular transmission line 22 is electrically connected to the fourth port 13 through the fourth connection part 73, and third long strip transmission line 32 is electrically connected to the fourth port 13 through the fourth connection part 73.

The aforesaid transmission lines can be microstrip lines or other transmission lines.

In at least one exemplary embodiment, the length L and width H of the disclosed branch-line coupler 100 are respectively 4.24 mm and 6.9 mm.

Figure 2:
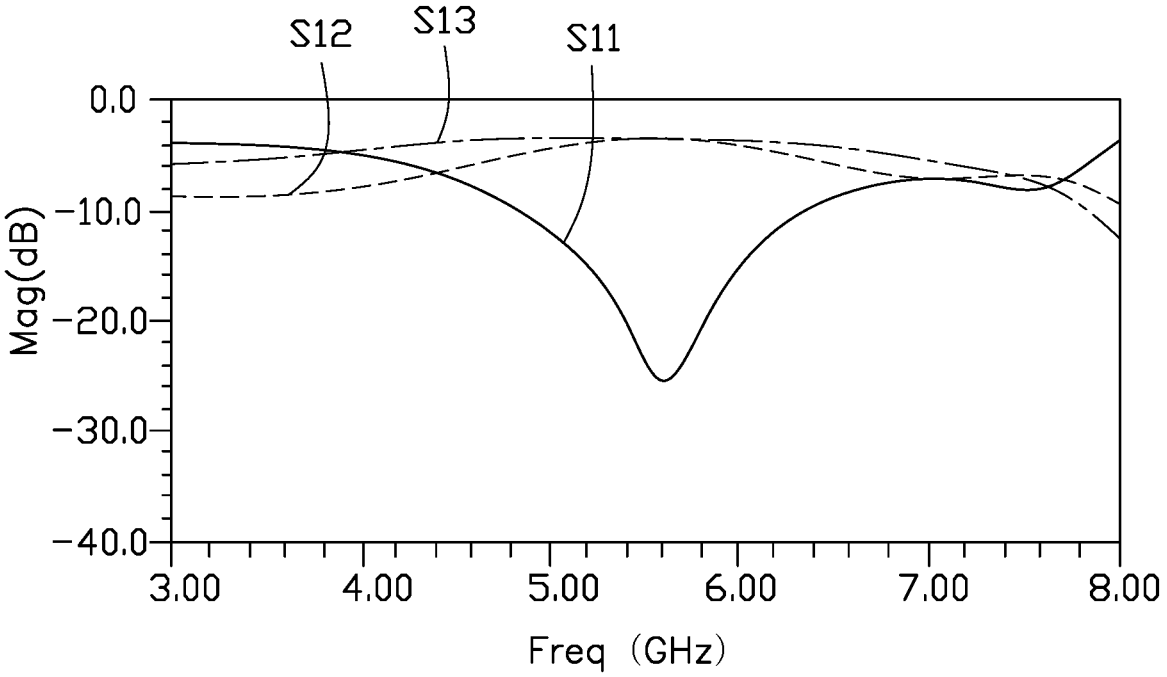
FIG. 2 is an s-parameter simulation diagram of a branch-line coupler according to an embodiment of the disclosure, wherein Freq denotes frequency and Mag denotes magnitude.

FIG. 2 shows an s-parameter simulation diagram of a branch-line coupler 100 according to an embodiment of the disclosure. In FIG. 2, the frequency band of the branch-line coupler 100 corresponding to the parameter of S11 below −10 dB is between 4.6 Ghz and 6.6 Ghz, the center frequency is 5.6 Ghz. The S12 and S13 parameters have 3 dB power loss at that frequency band.

Figure 3:
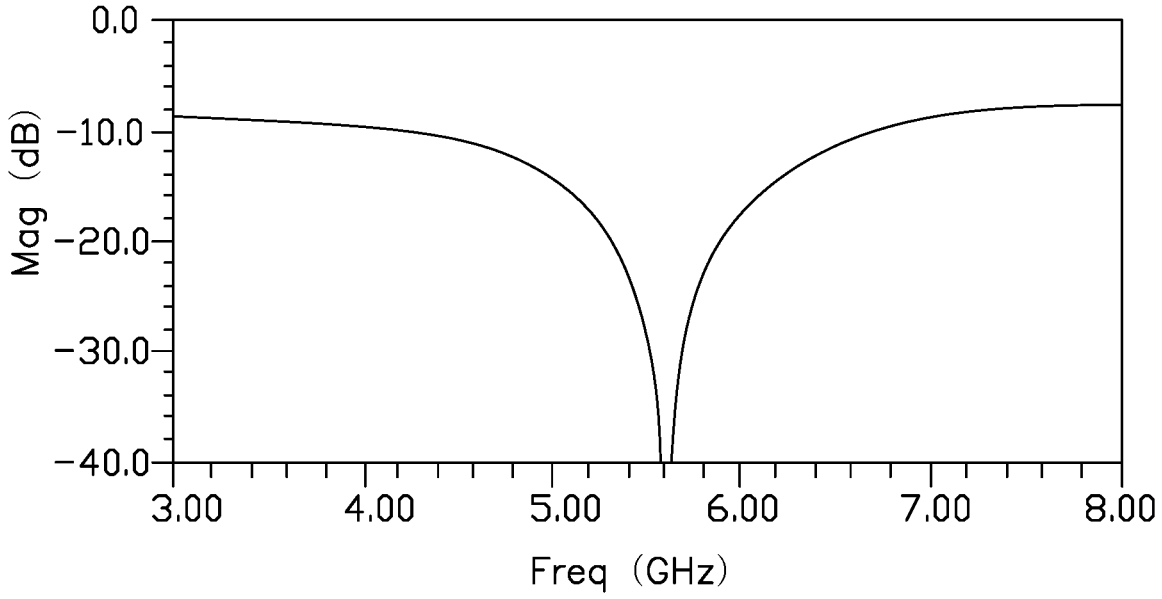
FIG. 3 is an s-parameter simulation diagram of degree of isolation between two output ports of a branch-line coupler, according to an embodiment of the disclosure.

FIG. 3 shows an s-parameter simulation diagram of isolation degree of two output ports of a branch-line coupler 100 according to an embodiment of the disclosure. FIG. 3 shows that the two outputs of the branch-line coupler 100 have a high degree of isolation at the frequency band of 4.6 Ghz to 6.6 Ghz.

Figure 4:
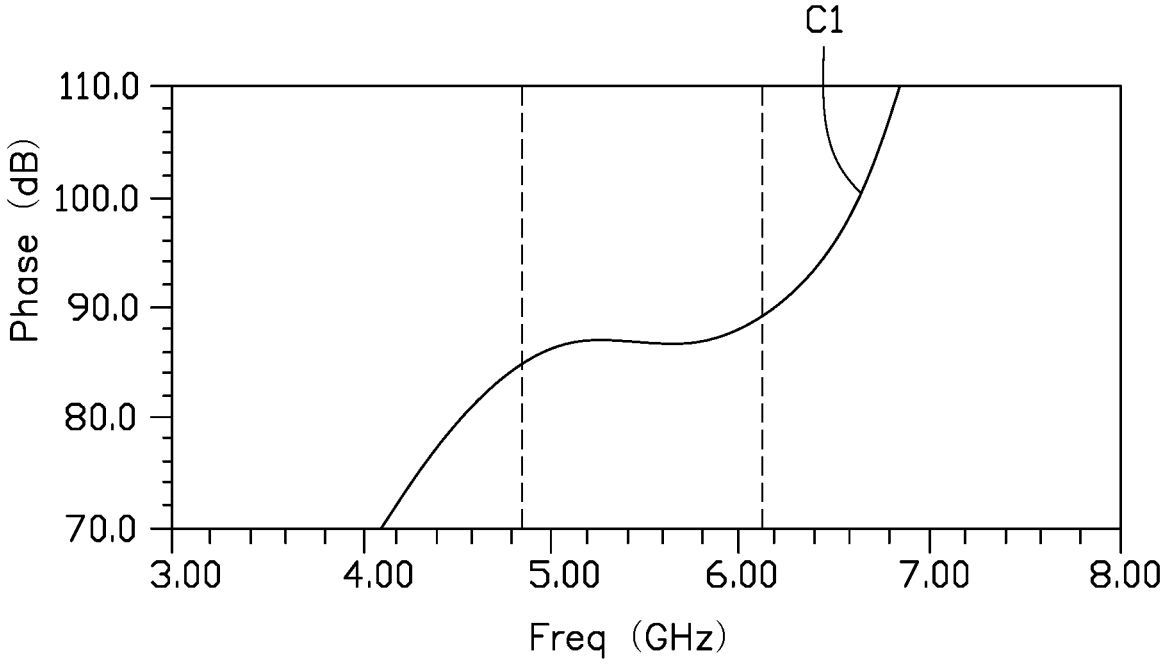
FIG. 4 is an output phase difference diagram of two output ports of a branch-line coupler, according to an embodiment of the disclosure.

FIG. 4 shows an output phase difference diagram of two output ports of a branch-line coupler 100 according to an embodiment of the disclosure. In FIG. 4, the second port 11 and the third port 12 have a small phase difference at the frequency band of 4.9 Ghz to 6.2 Ghz. Specifically, the output phase difference of the second port 11 and the third port 12 is less than 10°.

Figure 5:
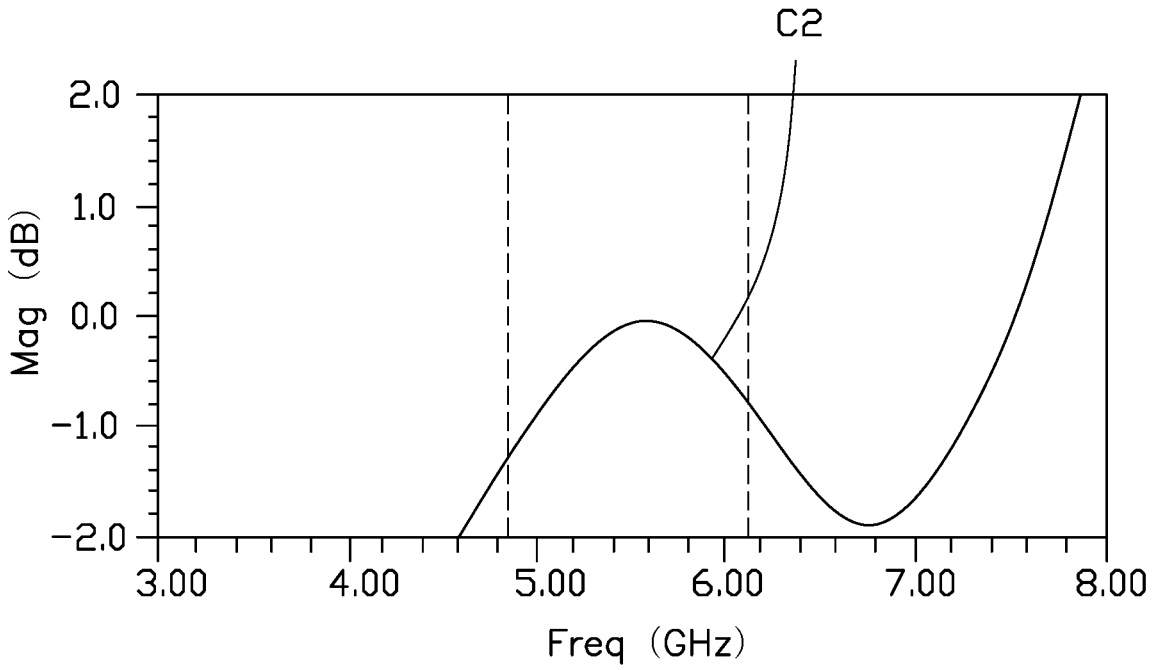
FIG. 5 shows magnitude difference diagram of two output ports of a branch-line coupler, according to an embodiment of the disclosure.

FIG. 5 shows a magnitude difference between two output ports of a branch-line coupler 100 according to an embodiment of the disclosure. In FIG. 5, the second port 11 and the third port 12 of the branch-line coupler 100 have a small magnitude difference at the frequency band 4.9 Ghz to 6.2 Ghz. Specifically, the magnitude difference between the second port 11 and the third port 12 is less than 2 dB.

Figure 6:
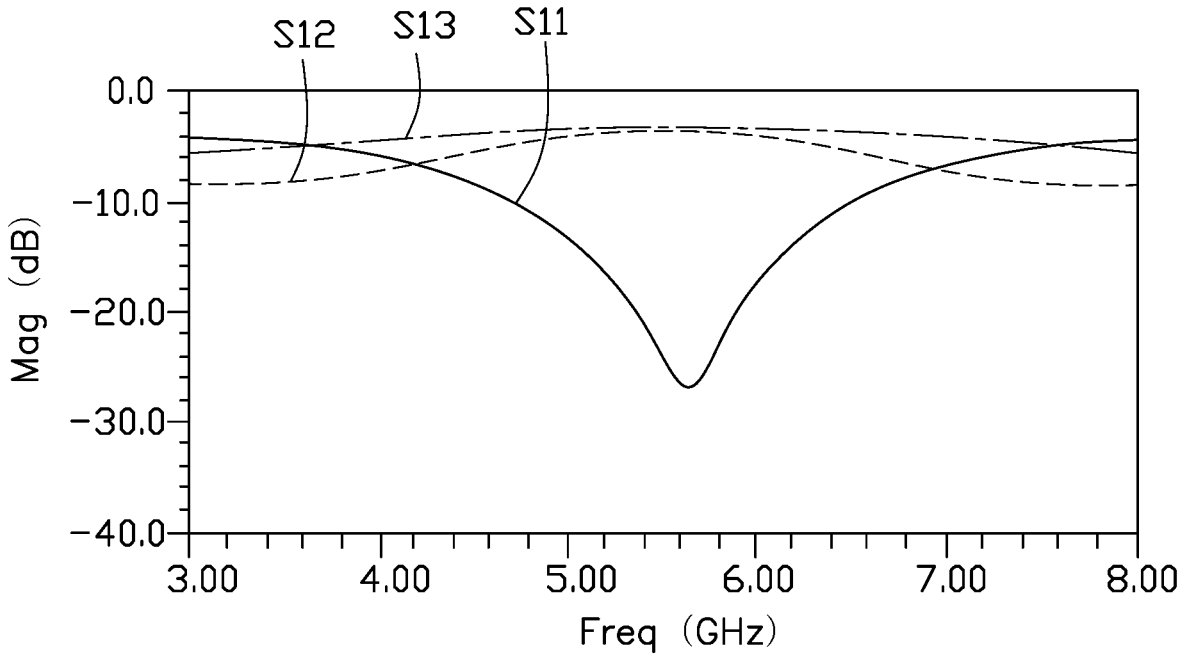
FIG. 6 is an s-parameter simulation diagram of a conventional branch-line coupler.

FIG. 6 shows an s-parameter simulation diagram of a conventional branch-line coupler. As FIG. 6 shows, the frequency band corresponding to the parameter SI 1 of the conventional branch-line coupler below −10 dB is 4.6 Ghz to 6.6 Ghz. The center frequency is 5.6 Ghz, and the S12, S13 parameters have 3 dB power loss at the frequency band of 4.6 Ghz to 6.6 Ghz.

Comparing the illustrations in FIG. 2 and FIG. 6, the branch line coupler 100 has a performance as good as that of a conventional branch-line coupler.

The branch-line coupler 100 formed by angular transmission lines decreases the size of the branch-line coupler as compared with the conventional branch-line coupler formed by linear transmission lines. In addition, the branch-line coupler 100 has good performance at the frequency band 4.6

Ghz to 6.6 Ghz The present coupler overcomes the disadvantage of occupying a large PCB area and is suitable for mobile communications.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure, up to and including the full extent established by the broad general meaning of the terms used in the claims.

What is claimed is:

1. A branch-line coupler, comprising:

an input port, a transmission port, a coupled port, and an isolated port;

a first angular transmission line, a second angular transmission line, and a first long strip transmission line; wherein the first angular transmission line is electrically connected between the input port and the transmission port, the second angular transmission line is electrically connected to a first end of the first angular transmission line, and the first long strip transmission line is electrically connected to a second end of the first angular transmission line;

a third angular transmission line, a fourth angular transmission line, and a second long strip transmission line; wherein the third angular transmission line is electrically connected between the coupled port and the isolated port, the fourth angular transmission line is electrically connected to a first end of the third angular transmission line, and the second long strip transmission line is electrically connected to a second end of the third angular transmission line;

a third long strip transmission line, a first branch transmission line, a second branch transmission line, and a third branch transmission line; wherein the third long strip transmission line is electrically connected between the input port and the isolated port; wherein the first branch transmission line, the second branch transmission line, and the third branch transmission line are extended from the third long strip transmission line; and a fourth long strip transmission line, a fourth branch transmission line, a fifth branch transmission line, and a sixth branch transmission line; wherein the fourth long strip transmission line is electrically connected between the transmission port and the coupled port; wherein the fourth branch transmission line, the fifth branch transmission line, and the sixth branch transmission line are extended from the fourth long strip transmission line.

2. The branch-line coupler of claim 1, wherein the third long strip transmission line defines a first slot, the third branch transmission line is received in the first slot, and the first branch transmission line and the second branch transmission line are located on both sides of the third branch transmission line.

3. The branch-line coupler of claim 2, wherein the fourth long strip transmission line defines a second slot, the sixth branch transmission line is received in the second slot, and the fourth branch transmission line and the fifth branch transmission line are located on both sides of the sixth branch transmission line.

4. The branch-line coupler of claim 3, wherein the first branch transmission line comprises a first connection section and a second connection section, the first connection section is electrically connected to the third long strip transmission line, and the second connection section is perpendicularly connected to the first connection section to form a L-shaped section.

5. The branch-line coupler of claim 4, wherein the second branch transmission line comprises a third connection section and a fourth connection section, the third connection section is electrically connected to the third long strip transmission line, and the fourth connection section is perpendicularly connected to the third connection section to form the L-shape section.

6. The branch-line coupler of claim 5, wherein the third branch transmission line comprises a first extension section and a second extension section, the first extension section is electrically connected to the third long strip transmission line, and the second extension section is perpendicularly connected to the first extension section to form a T-shaped section.

7. The branch-line coupler of claim 1, wherein the fourth branch transmission line comprises a fifth connection section and a sixth connection section, the fifth connection section is electrically connected to the fourth long strip transmission line, and the sixth connection section is perpendicularly connected to the fifth connection section to form a L-shaped section.

8. The branch-line coupler of claim 7, wherein the fifth branch transmission line comprises a seventh connection section and an eighth connection section, the seventh connection section is electrically connected to the fourth long strip transmission line, and the eighth connection section is perpendicularly connected to the seventh connection section to form the L-shape.

9. The branch-line coupler of claim 8, wherein the sixth branch transmission line comprises a third extension section and a fourth extension section, the third extension section is electrically connected to the fourth long strip transmission line, and the fourth extension section is perpendicularly connected to the third extension section to form a T-shaped section.

10. The branch-line coupler of claim 1, wherein the branch-line coupler further comprises a first connection part, the first angular transmission line is electrically connected to the input port through the first connection part, and the third long strip transmission line is electrically connected to the input port through the first connection part.

11. The branch-line coupler of claim 10, wherein the branch-line coupler further comprises a second connection part, the first angular transmission line is electrically connected to the transmission port through the second connection part, the fourth long strip transmission line is electrically connected to the through the second connection part.

12. The branch-line coupler of claim 11, wherein the branch-line coupler further comprises a third connection part, the third angular transmission line is electrically connected to the coupled port through the third connection part, and fourth long strip transmission line is electrically connected to the coupled port through the third connection part.

13. The branch-line coupler of claim 12, wherein the branch-line coupler further comprises a fourth connection part, the third angular transmission line is electrically connected to the isolated port through the fourth connection part, and third long strip transmission line is electrically connected to the isolated port through the fourth connection part.

14. The branch-line coupler of claim 13, wherein the first connection part, the second connection part, the third connection part, and the fourth connection part are transmission lines.

15. A branch-line coupler, comprising:

an input port, a transmission port, a coupled port, and an isolated port;

a first angular transmission line, a second angular transmission line, and a first long strip transmission line; wherein the first angular transmission line is electrically connected between the input port and the transmission port, the second angular transmission line is electrically connected to a first end of the first angular transmission line, and the first long strip transmission line is electrically connected to a second end of the first angular transmission line;

a third angular transmission line, a fourth angular transmission line, and a second long strip transmission line; wherein the third angular transmission line is electrically connected between the coupled port and the isolated port, the fourth angular transmission line is electrically connected to a first end of the third angular transmission line, and the second long strip transmission line is electrically connected to a second end of the third angular transmission line;

a third long strip transmission line, a first branch transmission line, a second branch transmission line, and a third branch transmission line; wherein the third long strip transmission line is electrically connected between the input port and the isolated port; wherein the first branch transmission line, the second branch transmission line, and the third branch transmission line are extended from the third long strip transmission line; and a fourth long strip transmission line, a fourth branch transmission line, a fifth branch transmission line, and a sixth branch transmission line; wherein the fourth long strip transmission line is electrically connected between the transmission port and the coupled port; wherein the fourth branch transmission line, the fifth branch transmission line, and the sixth branch transmission line are extended from the fourth long strip transmission line;

wherein the third long strip transmission line defines a first slot, the third branch transmission line is received in the first slot, and the first branch transmission line and the second branch transmission line are located on both sides of the third branch transmission line; and wherein the fourth long strip transmission line defines a second slot, the sixth branch transmission line is received in the second slot, and the fourth branch transmission line and the fifth branch transmission line are located on both sides of the sixth branch transmission line.

16. The branch-line coupler of claim 15, wherein the first branch transmission line comprises a first connection section and a second connection section, the first connection section is electrically connected to the third long strip transmission line, and the second connection section is perpendicularly connected to the first connection section to form a L-shaped section.

17. The branch-line coupler of claim 16, wherein the second branch transmission line comprises a third connection section and a fourth connection section, the third connection section is electrically connected to the third long strip transmission line, and the fourth connection section is perpendicularly connected to the third connection section to form the L-shape section.

18. The branch-line coupler of claim 17, wherein the third branch transmission line comprises a first extension section and a second extension section, the first extension section is electrically connected to the third long strip transmission line, and the second extension section is perpendicularly connected to the first extension section to form a T-shaped section.

19. The branch-line coupler of claim 15, wherein the fourth branch transmission line comprises a fifth connection section and a sixth connection section, the fifth connection section is electrically connected to the fourth long strip transmission line, and the sixth connection section is perpendicularly connected to the fifth connection section to form a L-shaped section.

20. The branch-line coupler of claim 19, wherein the fifth branch transmission line comprises a seventh connection section and an eighth connection section, the seventh connection section is electrically connected to the fourth long strip transmission line, and the eighth connection section is perpendicularly connected to the seventh connection section to form the L-shape; and wherein the sixth branch transmission line comprises a third extension section and a fourth extension section, the third extension section is electrically connected to the fourth long strip transmission line, and the fourth extension section is perpendicularly connected to the third extension section to form a T-shaped section.

* * * * *